US009683799B2

(12) United States Patent
Tusting

(10) Patent No.: US 9,683,799 B2
(45) Date of Patent: Jun. 20, 2017

(54) REVOLVER LOUVER

(71) Applicant: Paul A. Tusting, Salt Lake City, UT (US)

(72) Inventor: Paul A. Tusting, Salt Lake City, UT (US)

( * ) Notice: Subject to any disclaimer, the term of this patent is extended or adjusted under 35 U.S.C. 154(b) by 0 days.

(21) Appl. No.: 15/248,663

(22) Filed: Aug. 26, 2016

(65) Prior Publication Data

US 2016/0363400 A1 Dec. 15, 2016

Related U.S. Application Data

(62) Division of application No. 14/517,356, filed on Oct. 17, 2014, now Pat. No. 9,453,696.

(60) Provisional application No. 61/892,771, filed on Oct. 18, 2013.

(51) Int. Cl.
*F41C 3/14* (2006.01)
*F41A 13/06* (2006.01)

(52) U.S. Cl.
CPC ..... *F41A 13/06* (2013.01); *F41C 3/14* (2013.01)

(58) Field of Classification Search
CPC ..... F41A 13/06; F41C 3/14
USPC ..... 42/59
See application file for complete search history.

(56) References Cited

U.S. PATENT DOCUMENTS 28,331 A 5/1860 Savage
1,049,105 A * 12/1912 Key ..... F41A 15/02 42/59
1,049,106 A * 12/1912 Key ..... F41A 9/28 42/59
1,491,653 A * 4/1924 Ashcroft ..... C22B 1/08 423/494
3,136,084 A * 6/1964 Charron ..... F41C 3/14 42/59
4,041,633 A * 8/1977 Scrufari ..... F41C 3/14 42/59
4,253,261 A * 3/1981 Schmidt ..... F41C 3/14 42/59

(Continued)

FOREIGN PATENT DOCUMENTS

GB 14010 0/1894

OTHER PUBLICATIONS

Special Purpose Small Arms Ammunition of USSR and Russia, World Guns, http://world.guns.ru/ammunition/russian-special-cartridges-e.html.

(Continued)

*Primary Examiner* — Samir Abdosh
(74) *Attorney, Agent, or Firm* — Dobbin IP Law; Geoffrey E. Dobbin

(57) ABSTRACT

The present invention is revolver louver which redirects the hot propellant gases which leak from the barrel-cylinder gap away from the user. The louver provides at least one directional passages which control the flow of propulsion gases after firing the revolver. Numerous embodiments are disclosed including some having an expansion capability to further block gas passage and one embodiment which is an extension of the revolver frame itself. One embodiment further comprises an expansion groove to further block the passage of propulsion gases. As such, the present invention's general purpose is to provide a new and improved revolver that is more compact and safer for the user than a conventional revolver.

3 Claims, 10 Drawing Sheets

(56) References Cited

U.S. PATENT DOCUMENTS

| | | | | |
|---|---|---|---|---|
| 4,897,950 | A * | 2/1990 | Lechelle | F41C 3/14 42/62 |
| 6,609,323 | B1 * | 8/2003 | Donnelly | F41A 3/76 42/59 |
| 7,562,478 | B1 * | 7/2009 | Vastag | F41C 3/14 42/51 |
| 8,621,772 | B1 * | 1/2014 | Kunau | F41C 3/14 42/59 |
| 9,423,196 | B2 * | 8/2016 | Kunau | F41A 3/76 |
| 2010/0192441 | A1 * | 8/2010 | Curry | F41C 3/14 42/62 |

OTHER PUBLICATIONS

Smith and Wesson forum, RJ Braverman revolver, http://www.smithandwessonforums.com/forum/revolver-forum/5530-r-j-braverman-revolver.html. See edited image on p. 3.

Rossi Firearms, Owner's Manual Shotgun/Rifle Circuit Judge (TM), Copyright 2011 by Braztech International, L.C., pp. 22-23, Part Nos. 73 & 74, http://www.rossiusa.com/product-list.cfm?category=15.

* cited by examiner

REVOLVER LOUVER

CROSS-REFERENCES TO RELATED APPLICATIONS

This application claims priority as a divisional application of prior filed U.S. non-provisional application Ser. No. 14/517,356, filed Oct. 14, 2014, which is in turn a non-provisional perfection of prior filed U.S. Provisional Application No. 61/892,771, filed Oct. 18, 2014. Both applications are incorporated by reference herein in their entirety.

FIELD OF THE INVENTION

The present invention relates to the field of firearms and more particularly relates to a revolver louver which redirects gases that escape through the barrel-cylinder gap.

BACKGROUND OF THE INVENTION

Revolvers offer multiple advantages over auto-loading pistols, including increased reliability and simplicity of use. Yet, there are some advantages of auto-loading pistols over revolvers. One advantage of auto-loading pistols is that the one-piece construction of the barrel assembly prevents hot propulsion gases, resultant of firing the pistol, from leaking out in the direction of the user.

A chamber is the region of firearm which houses the cartridge. A cartridge contains the projectile or bullet, the cartridge case, propellant, and primer. When the propellant within a cartridge is ignited by the firing pin striking the primer, pressure builds until the projectile overcomes the friction from the cartridge case and starts traveling towards the end of the firearm's barrel, as it is path of least resistance. Additionally, the cartridge case swells until it is supported directly by the chamber, which surrounds the cartridge and is made of a rigid material. Cartridge cases are designed to be thin walled and are constructed of malleable materials such that the expanding cartridge case seals against the walls of the chamber, preventing hot gases from moving rearward around the cartridge case and towards the user.

With auto-loading pistols, and other non-revolving handguns such as single shot pistols and multi-shot derringers, the chamber is part of the barrel. As a result, once the cartridge has expanded to seal against the walls of the chamber, the only place the hot propellant gases can go is down and out of the barrel. With conventional revolvers, the chambers are part of the revolving cylinder, not the barrel. Additionally, in order to allow the cylinder to reliability rotate under adverse conditions, a certain gap is required between it and the barrel. This gap is commonly referred to as the barrel-cylinder gap and for a typical revolver it measures approximately between 0.005 and 0.015 inches (though there are a few exceptions to this range). It is worth noting that although unusual, there are firearms other than revolvers in which the barrel and chamber are separate components, such as rifles which have sliding, pivoting or rotating chambers, which may also benefit from the disclosed invention. There is also a frame-cylinder gap, for similar reasons as described above, which is in fluid communication with the barrel-cylinder gap.

The propellant gases which leak from the barrel-cylinder gap and the associated frame-cylinder gap are hot enough to burn the user if proximate to this region. In the case of extremely powerful magnum cartridges, being exposed to the gases leaking from the barrel-cylinder gap can severely damage, and even sever, finger digits.

Additionally, if the revolver is not very precisely manufactured and assembled such that the barrel is nearly perfectly aligned with the chamber being fired, pieces of the projectile can be sheared off as it enters the barrel and cause injury to the user. The phenomenon of pieces of the projectile being sheared off due to a misalignment between the barrel and cylinder chamber is commonly referred to as spitting.

There have been past attempts to seal the barrel-cylinder gap, eliminating the hazards described above, by either moving the cylinder forward just before cartridge ignition such that it seals against the barrel (Savage Navy Model Revolver of 1861, as disclosed in patent US28331), by using specialty ammunition which contains an integrated seal (such as Soviet PZAM, SP-3, and SP-4 ammunition), or a combination of both (Nagant M1895 Revolver, as disclosed in patent GB14010). In the cases where the cylinder is moved to seal against the barrel, while the seal tends to be secure and effective, the mechanism necessary for such movement adds to the complexity and size of the revolver's systems and any complexity inevitably increases risk of unpredictable failure. As with any firearm, an unpredictable failure, at the wrong moment, could cost a user vital time either as a total malfunction or even is merely adding surprise to the user's sensory input. While seals integral to the ammunition may also serve adequately, they only work when given ammunition is purchased and used. What is needed, then is a simpler, more reliable redirection system which, ideally, has no or few moving parts to fail and is integral to the firearm itself.

The present invention is a non-relocating means of redirecting the hot propulsion gases, which leak from the gap between the barrel and cylinder of conventional revolvers, away from the user and in a safe direction.

SUMMARY OF THE INVENTION

In view of the foregoing disadvantages inherent in the known types of revolvers, this invention provides a means to redirect propulsion gases leaking from the barrel-cylinder gap. As such, the present invention's general purpose is to provide a new and improved revolver that is more compact and safer for the user than a conventional revolver.

The present invention does not attempt to completely seal the gases escaping from the barrel-cylinder gap, instead it simply redirects them away from the user utilizing a louver positioned in the frame-cylinder gap. Although the preferred direction for the barrel-cylinder gases to be directed is upwards, as reflected in the figures below, other directions are possible and within the scope of the disclosure invention.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS

Figure 1:
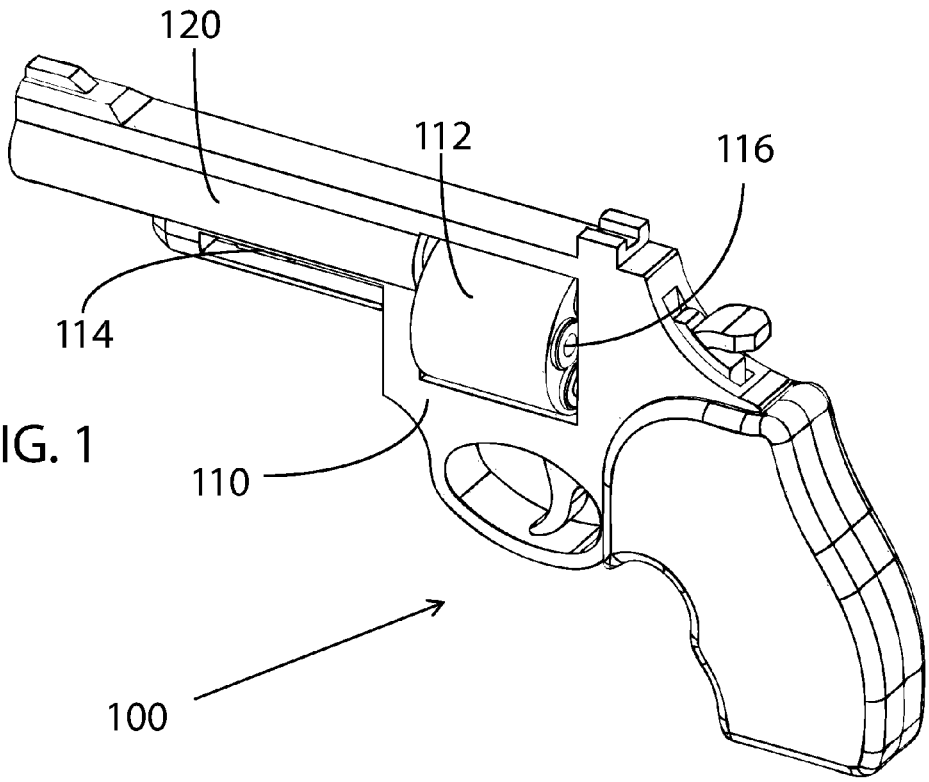
FIG. 1 is a perspective view of a typical revolver.
Figure 2:
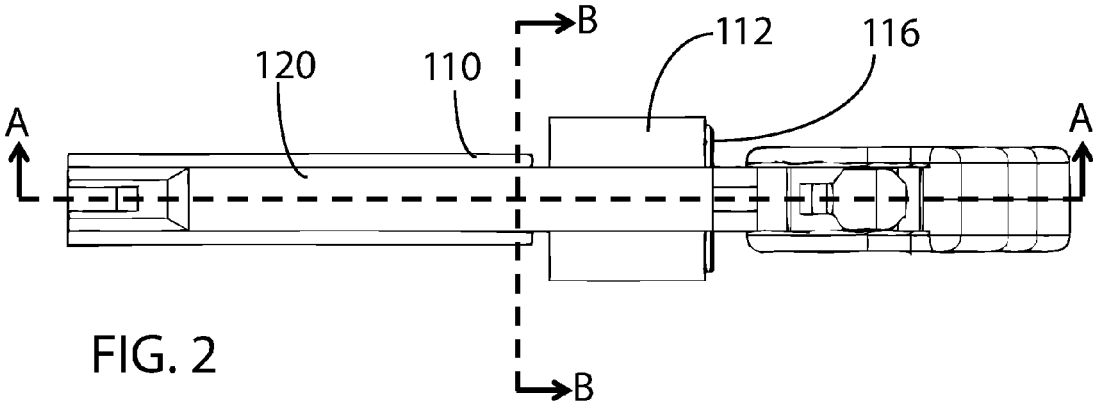
FIG. 2 is a top elevation view of a typical revolver of FIG. 1.

With reference now to the drawings, the preferred embodiment and alternate embodiments of the revolver are herein described. It should be noted that the articles "a", "an", and "the", as used in this specification, include plural referents unless the content clearly dictates otherwise. Reference numerals indicated in the specification are consistent through all drawing sheets and indicate the following items:

100—a typical revolver;
110—frame;
112—cylinder;
114—center pin;
116—cartridge;
118—chamber;
120—barrel;
122—barrel throat;
124—bushing;
126—ratchet pad;
128—barrel-cylinder gap;
130—frame-cylinder gap;
210—revolver louver;
212—louver branches;
214—louver trunk;
220—alternate barrel;
224—alternate bushing;
310—second embodiment of a revolver louver;
312—expansion groove;
314—expansion groove trough;
410—third embodiment of a revolver louver;
412—expansion groove of the third embodiment;
414—expansion groove trough;
416—louver layers;
510—fourth embodiment of a revolver louver;
512—expansion groove of the fourth embodiment;
514—expansion groove trough;
610—fifth embodiment of a revolver louver;
612—expansion groove of the fifth embodiment;
614—expansion groove trough;
710—sixth embodiment of a revolver louver;
810—seventh embodiment of a revolver louver;
850—barrel port;
910—eighth embodiment of a revolver louver;
912—louver relief step;
924—alternate bushing feature.
950—alternate frame
960—alternate frame arms With reference to FIG. 1-2, a typical revolver 100 has the main components expected of a revolver, that is to say it has a frame 110, barrel 120, cylinder 112, center pin 114, and the ability to house at least one cartridge 116.

Figure 3:
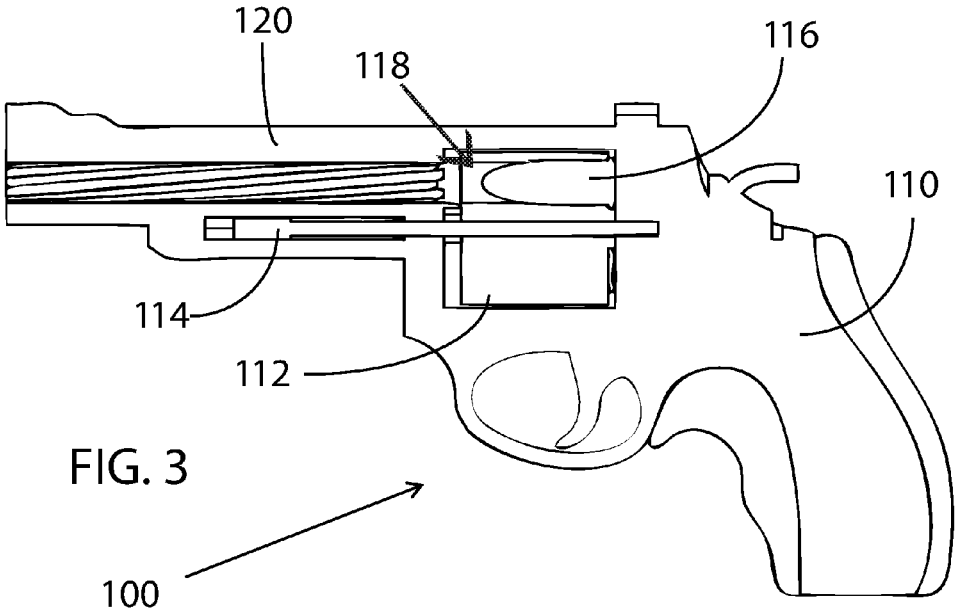
FIG. 3 is a side sectional view taken along line A-A of FIG. 2.
Figure 4:
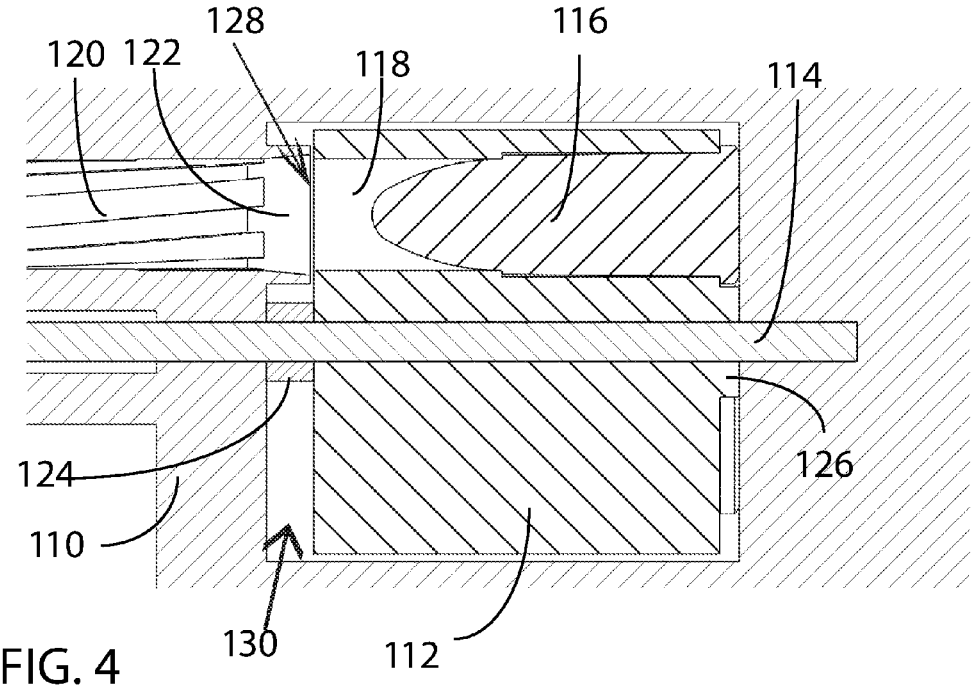
FIG. 4 is a side sectional view taken along line A-A of FIG. 2, featuring the cylinder.

FIG. 3 shows a cross-section of a typical revolver 100, taken along the Line A-A of FIG. 2, showing the components listed above, as well as, a chamber 118 of which there is often between five and ten of within a cylinder 112. The detailed cross-section of a cylinder 112, taken along the Line A-A of FIG. 2, of a typical revolver 100 as shown in FIG. 4 reveals how a cartridge 116 is dimensionally constrained. The cartridge 116 is located within the chamber 118 which is part of the cylinder 112. The rearward position of the cartridge 116 is constrained by the ratchet pad 126 of the cylinder 112 bearing on the frame 110. The forward position of the cartridge 116 is constrained by the cylinder 112 bearing on the bushing 124 which then bears on the frame 110. The axial clearance in this assembly is typically only 0.001-0.002 inches to prevent damage to the components during firing. The radial position of the cartridge 116 is constrained by the chamber 118 which, as part of cylinder 112, and is constrained by the center pin 114 which bears on the frame 110, in both the front and rear.

Also shown in FIG. 4 is how the chamber 118 aligns with the barrel 120 and specifically the throat 122, which is the tapered region of the barrel 120 that helps align the projectile component of the cartridge 116 during firing of the typical revolver 100. To guarantee proper operation of the typical revolver 100 during adverse conditions there must be a gap between the barrel 120 and cylinder 112, which is commonly referred to as the barrel-cylinder gap 128. Hot propulsion gases expand spherically unless constrained by an external feature. As a result, they leak from the barrel-cylinder gap 128 during firing of the typical revolver 100 in a radially symmetric pattern due to the constraints provided by the frame 110, cylinder, 112, and barrel 120. The purpose of disclosed invention is to redirect the gases leaking from the barrel-cylinder gap 128 away from the frame-cylinder gap 130, and consequently away from the user and in a safe direction, which may be upward, as defined by the top of the firearm, away from the grip.

Figure 5:
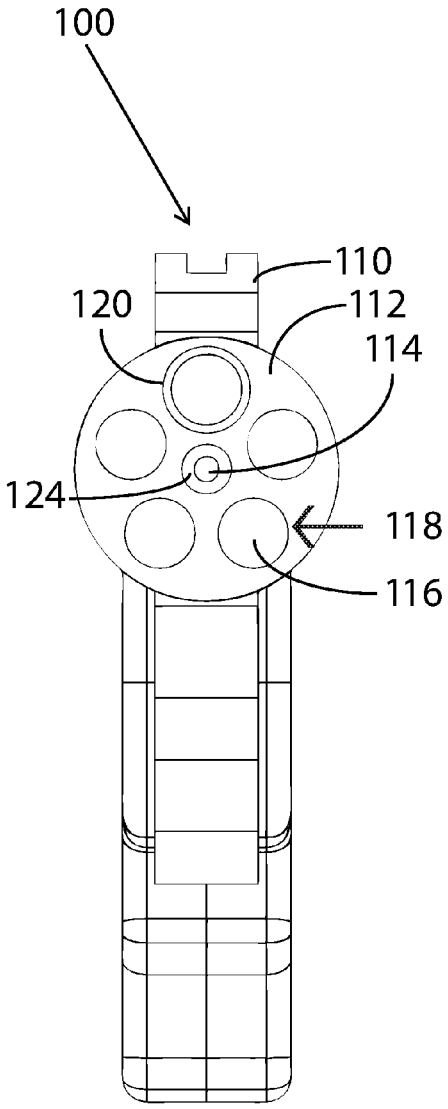
FIG. 5 is a front sectional view taken along line B-B of FIG. 2.

Shown in FIG. 5 is the cross-section of a typical revolver 100, taken along the Line B-B of FIG. 2, which reveals that the cylinder 112 contains more than one chamber 118, and that one chamber 118 aligns with the barrel 120. Shown in FIG. 6 is the detailed cross-section of a typical revolver 100, taken along the Line B-B of FIG. 2, showing the details of the assembly just in front of the cylinder 112, including the throat 122 region of the barrel 120, and its proximity to the bushing 124.

Figure 6:
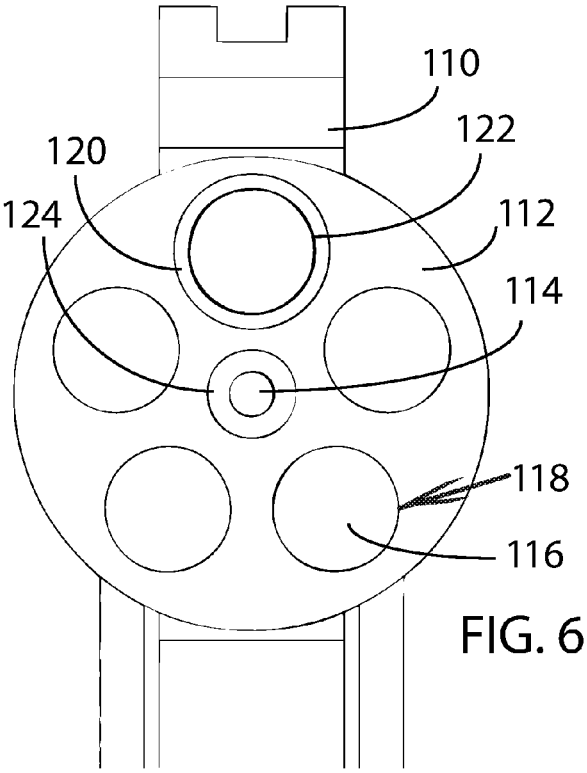
FIG. 6 is a front sectional view taken along line B-B of FIG. 2, featuring the cylinder.
Figure 7:
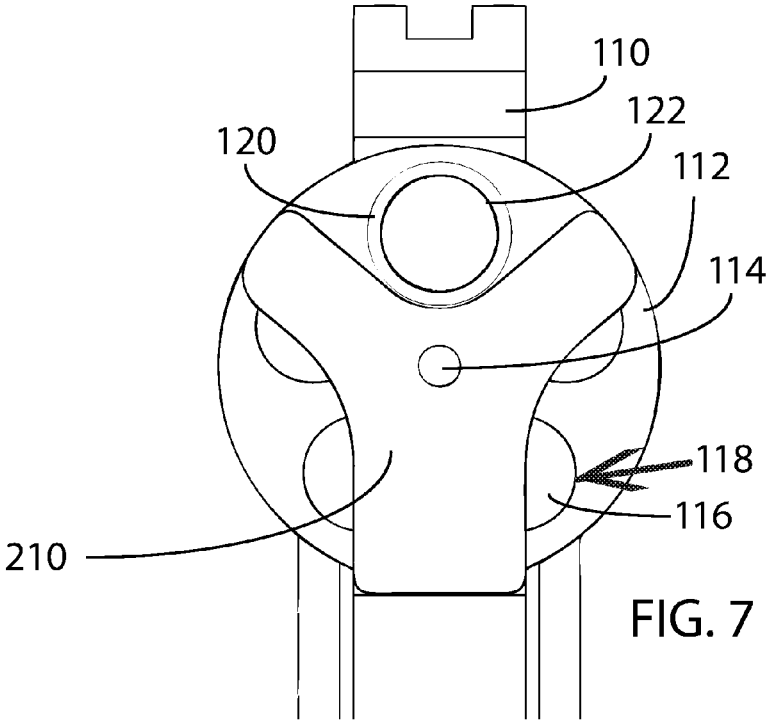
FIG. 7 is a front sectional view of a first embodiment of a revolver utilizing one embodiment of the louver.
Figure 8:
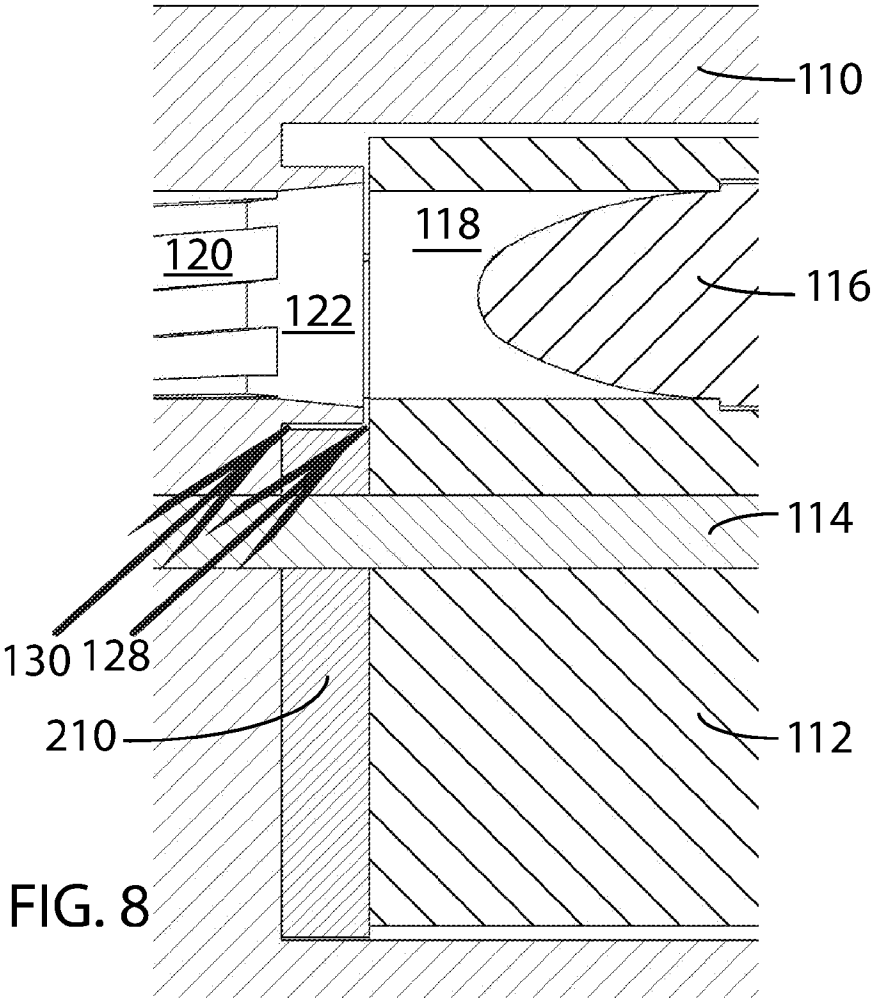
FIG. 8 is a sectional view, taken along line A-A of FIG. 2, of the revolver utilizing an embodiment of the louver.
Figure 21:
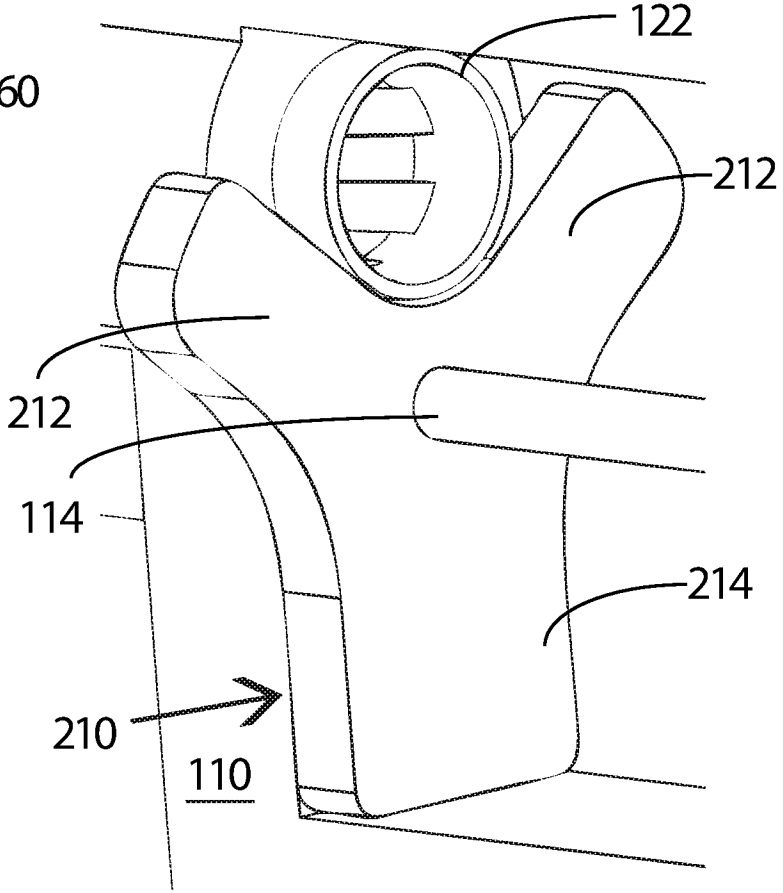
FIG. 21 is a partial rear perspective view of the revolver and louver of FIG. 7, without the cylinder.

Shown in FIG. 7 is the cross-section of a typical revolver 100, taken along the Line B-B of FIG. 2, as in FIG. 6, but the bushing 124 has been replaced with a revolver louver 210 in the frame-cylinder gap 130 (FIG. 8). Since the bushing 124 is a structural part of the cylinder 112 assembly and the louver 210 replaces said bushing 124, the material chosen for this embodiment of the revolver louver 210 must be rigid. Although the revolver louver 210 could be any shape which results in the gases leaking from the barrel-cylinder gap 128 to be redirected from their typical radially symmetric pattern, the preferred configuration is a Y-shape, as shown in FIGS. 7 and 21, with two upwards branches 212 and a downward trunk 214, at least partially surrounding the barrel throat 122. The partial surrounding of the barrel creates a damming structure and leaves a passage whereby gases are redirected from their normal radial expansion. Any shape may be utilized so long as a passage is left for gases to escape. In addition to the Y-shape disclosed in the drawings, a U-shape may also be used, as may a partial ring, utilizing one branch partially surrounding the barrel throat 122. The design merely needs to block gases from the frame-cylinder gap and direct them in a safe direction from the user.

FIG. 8 depicts the cross-section of the revolver louver 210 of FIG. 7, taken along the line A-A of FIG. 2. The barrel-cylinder gap 128 can be seen relative to the revolver louver 210. While the shown geometry will deflect the majority of the propulsion gases leaking from the barrel-cylinder gap 128, there is some axial tolerance between the revolver louver 210, cylinder 112, and ratchet pad 126 as mentioned above, along the major axis of the center pin 114, within the constraints of the frame 110, such that it may be possible for gases to leak downward between the revolver louver 210 and either the frame 110 or cylinder 112 towards the user. However, due to the axial clearance of the cylinder 112 along the axis of the center pin 114 being much less than the barrel-cylinder gap 128, and that the hot gases escaping from the barrel-cylinder gap 128 attempt to expand as a sphere of increasing radius, very little of the hot gases are likely to leak around the cylinder louver 210.

Figure 9:
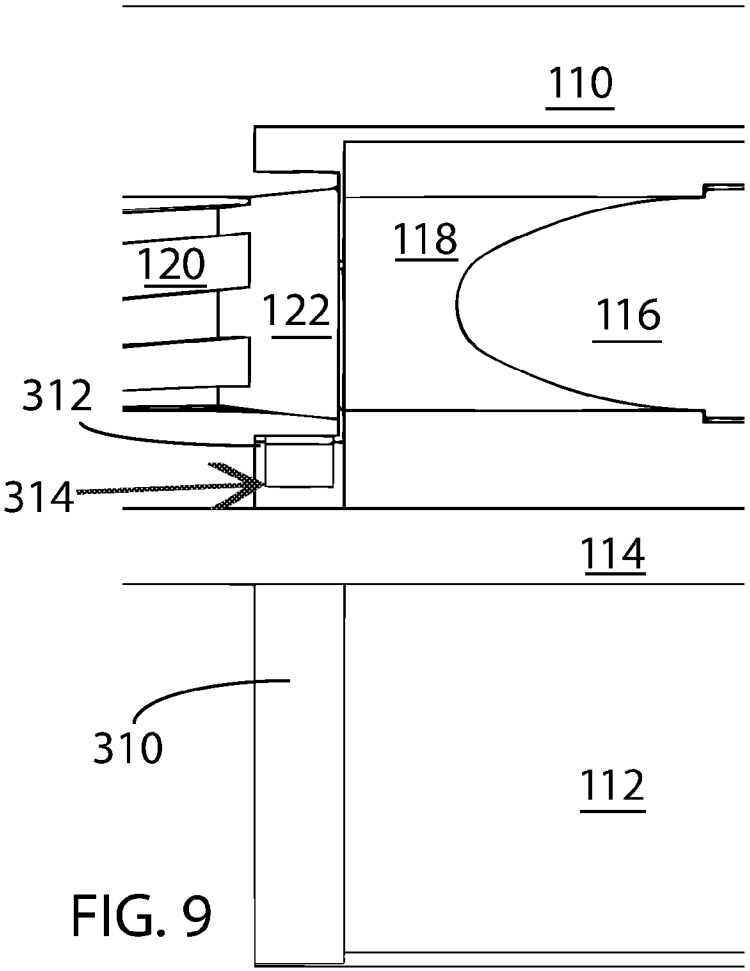
FIG. 9 is a sectional view, taken along line A-A of FIG. 2, of the revolver utilizing an embodiment of the louver with an expansion groove.

As a result of the possible gas leakage around the cylinder louver 210 described above, an alternate embodiment of the revolver louver 310 is shown in FIG. 9. A tangential expansion groove 312 within the alternate revolver louver 310 is thin-walled to expand axially, similar to how a cartridge case expands during firing, against the frame 110 and cylinder 112, preventing propulsion gases from leaking around the alternate cylinder louver 310 and towards the user. After the pressure has dropped in the system from the projectile exiting the barrel 120, the thin walls of the expansion groove 312 of the alternate revolver louver 310 return to their original positions and the cylinder 112 is free to rotate again. Although there are likely many acceptable materials to construct the alternate revolver louver 310 out of, spring tempered steel and high strength and high temperature resistant plastics, such as nylon and acetal, are potentially good choices. As shown, the cross-sectional shape, or trough 314, of the expansion groove 312 may be rectangular.

Figure 10:
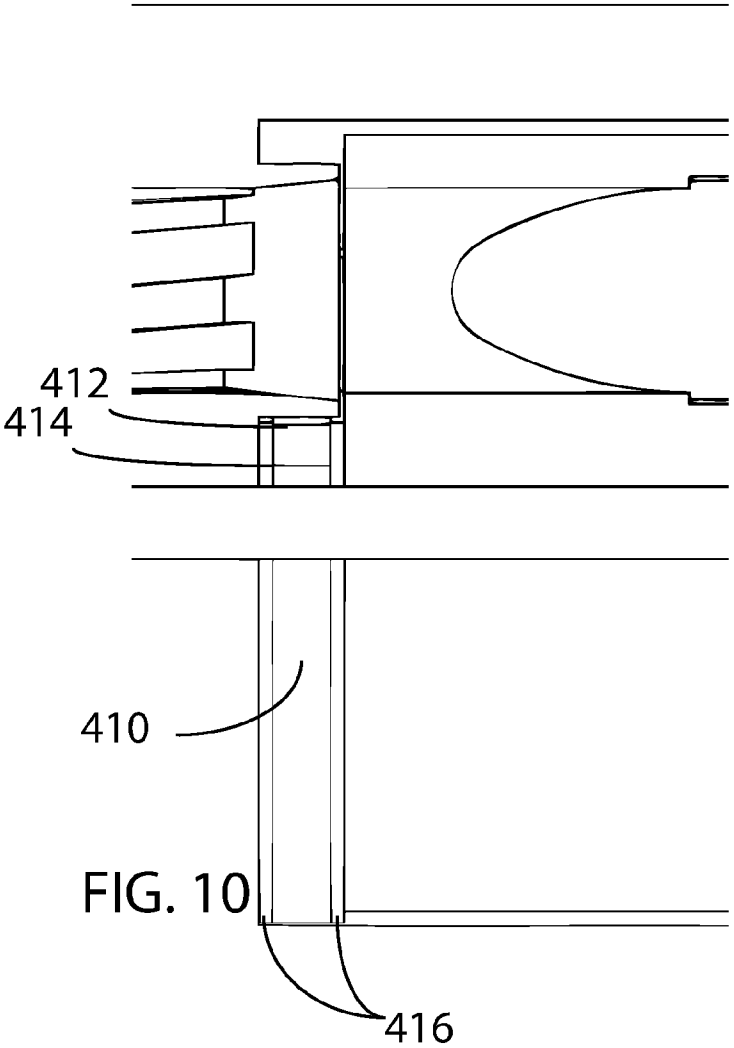
FIG. 10 is a sectional view, taken along line A-A of FIG. 2, of the revolver utilizing a third embodiment of the louver constructed of laminated layers.

Shown in FIG. 10 is another alternate revolver louver 410, which is similar to the one shown in FIG. 9 except that in addition to it having an expansion groove 412, it is constructed of laminated layers 416 to allow easier fabrication and/or varying material properties. Leaving the cross-sectional shape 414 of the expansion groove rectangular is a relatively easy and effective strategy with this construction.

Figure 11:
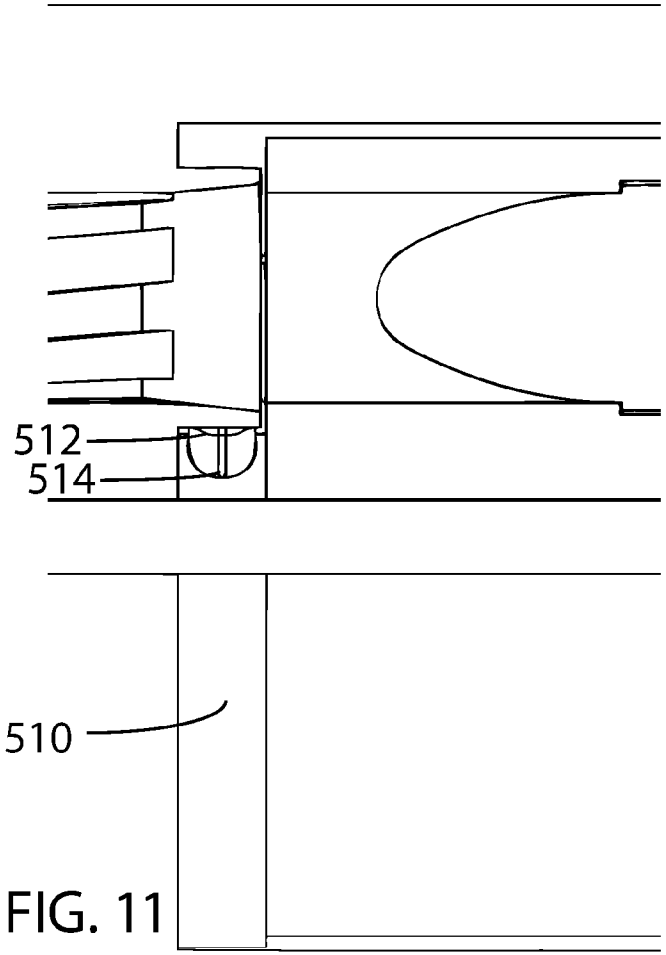
FIG. 11 is a sectional view, taken along line A-A of FIG. 2, of the revolver utilizing a fourth embodiment of the louver with a U-shaped expansion groove.

Shown in FIG. 11 is another alternate revolver louver 510, which is similar to the one shown in FIG. 9 except that in addition to it being expandable, the expansion groove 512 is U-shaped, with a curved cross-sectional shape 514.

Figure 12:
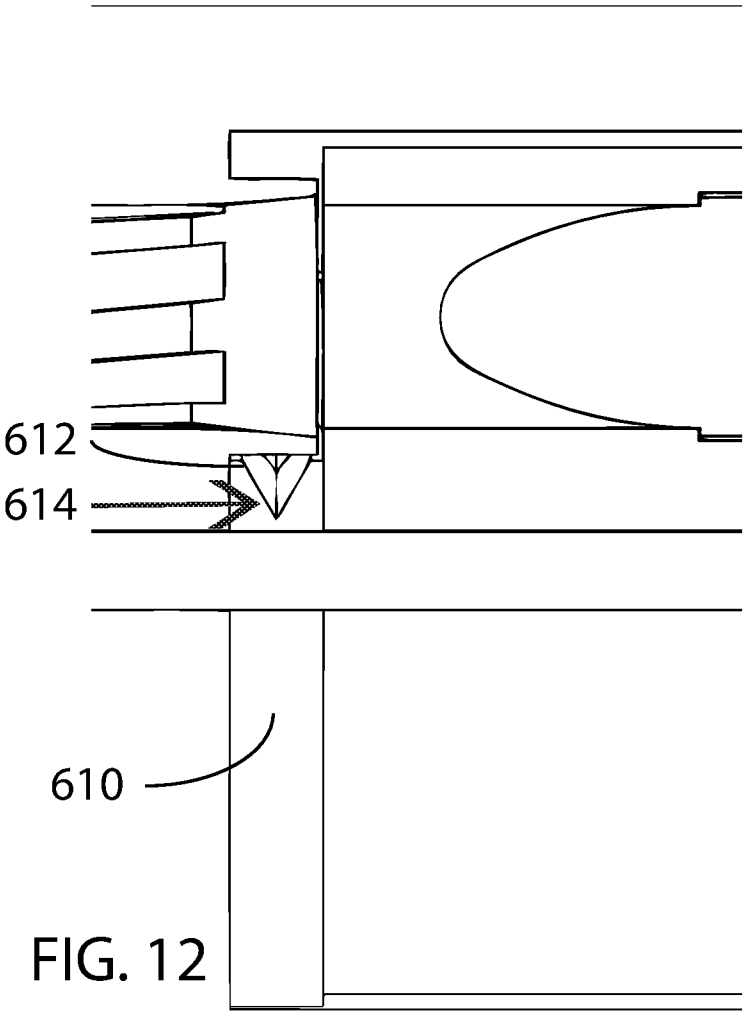
FIG. 12 is a sectional view, taken along line A-A of FIG. 2, of the revolver utilizing a fifth embodiment of the louver with a V-shaped expansion groove.

Shown in FIG. 12 is another alternate revolver louver 610, which is similar to the one shown in FIG. 9 except that in addition to it being expandable, the expansion groove 612 is V-shaped, with an angled cross-sectional shape 614.

Figure 13:
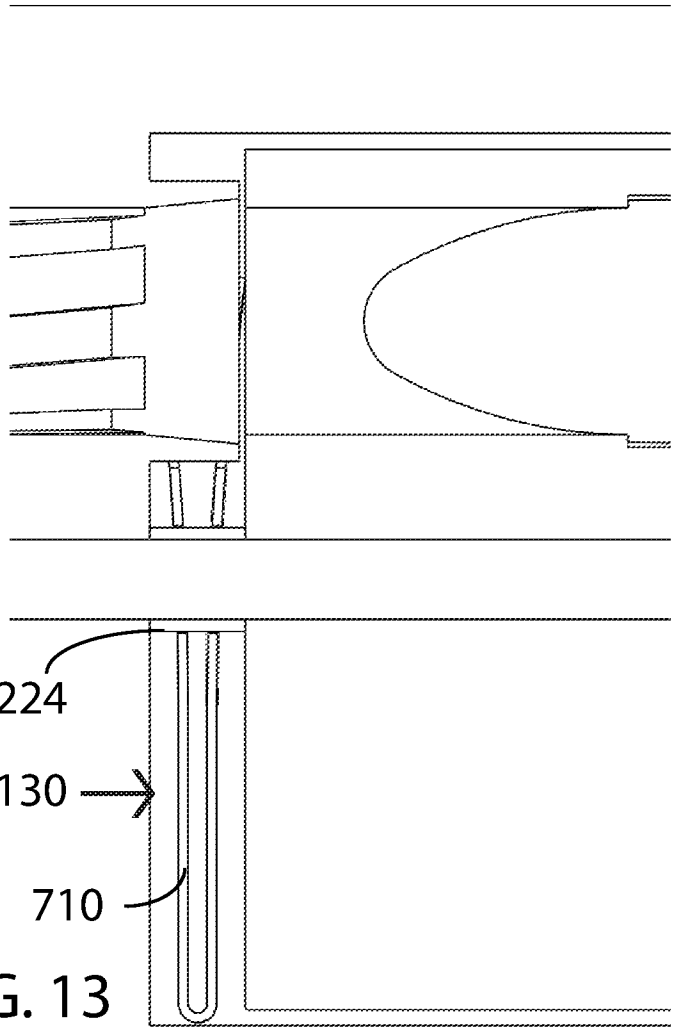
FIG. 13 is a sectional view, taken along line A-A of FIG. 2, of the revolver utilizing a sixth embodiment of the louver with an expansion groove and utilizing sheet metal construction.

Shown in FIG. 13 is another alternate revolver louver 710, which is similar to the one shown in FIG. 9 except that in addition to it being expandable, it is constructed from sheet metal. Since the sheet metal alternate revolver louver 710 cannot support an axial load, an alternate bushing 224 is required, which is possibly smaller in diameter than the original bushing 124. This alternate louver 710 blocks the frame-cylinder gap 130 after firing and gasses fill the louver 710, expanding both of its leaves outward to seal the frame-cylinder gap 130.

Figure 15:
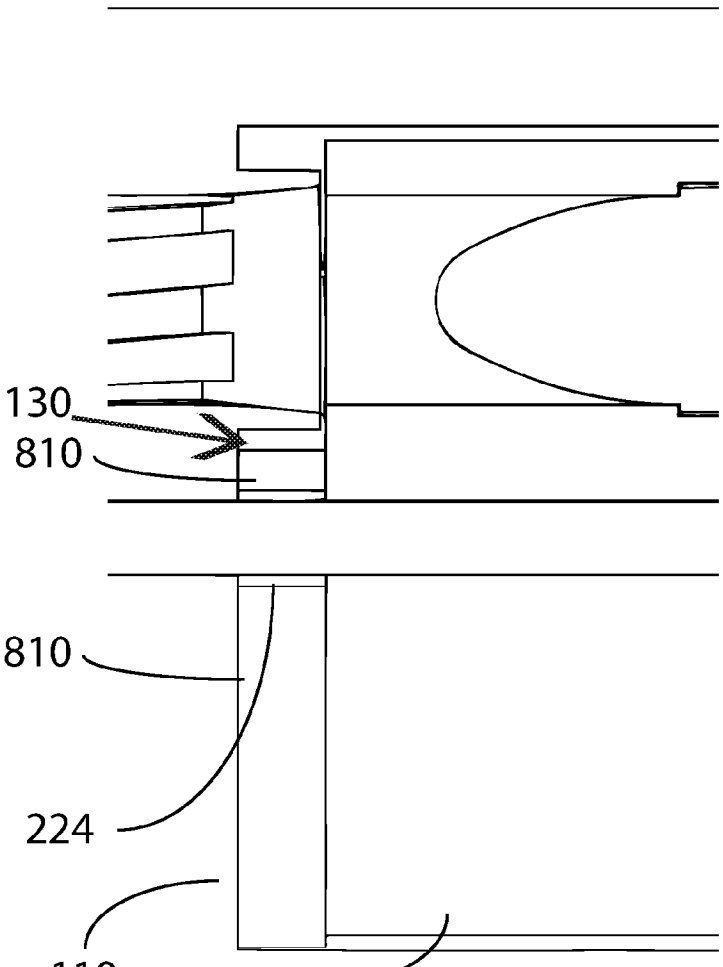
FIG. 15 a sectional view, taken along line A-A of FIG. 2, of the revolver utilizing the louver of FIG. 14, in a compressed position.
Figure 14:
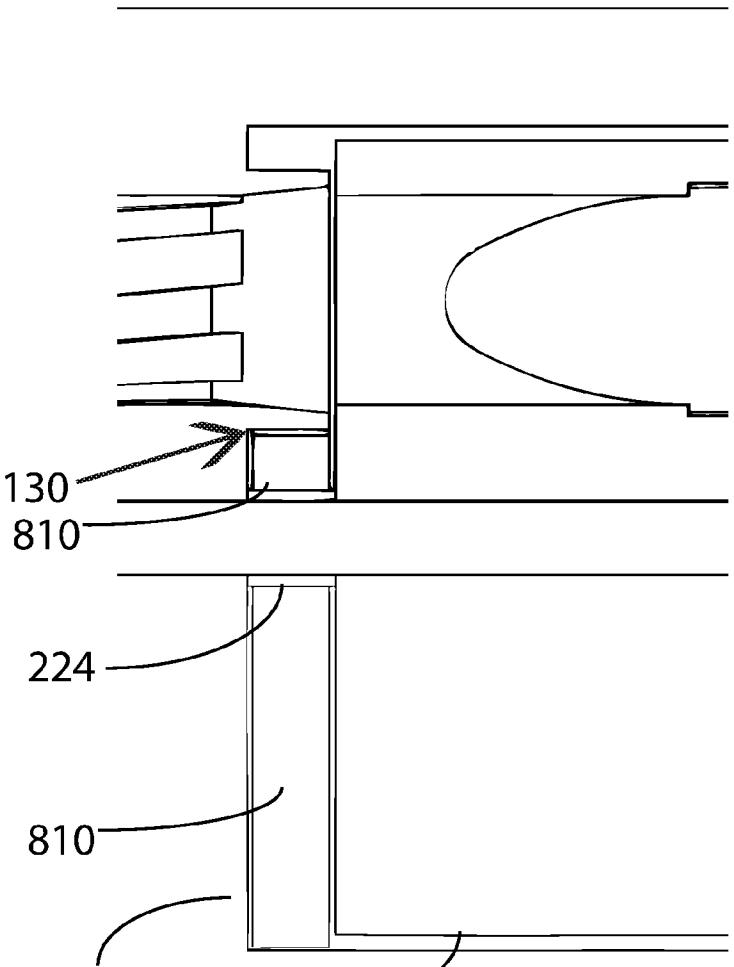
FIG. 14 is a sectional view, taken along line A-A of FIG. 2, of the revolver utilizing a seventh embodiment of the louver that is constructed of a compressible material.

Shown in FIG. 14 is another alternate revolver louver 810, which is similar to the one shown in FIG. 9 except that instead of it expanding axially due to pressure on the thin walls of an expansion groove, it expands axially due to being constructed of a compressible material. Radial pressure from the propulsion gases forces the louver to compress downward which in turn causes it to expand along the major axis of the center pin 114. Like with alternate revolver louver 710, this embodiment cannot support an axial load, and an alternate bushing 224 is required. FIG. 15 shows the alternate revolver louver 810 in its compressed position, having axially expanded and contacting the frame 110 and cylinder 112, thereby filling frame-cylinder gap 130. Like with the other expanding designs, alternate revolver louver 810, will return to its initial position once pressure has dropped in the system. A high temperature elastomer would be ideal in this embodiment as the material must withstand the heat of the propulsion gases without degrading.

Figure 16:
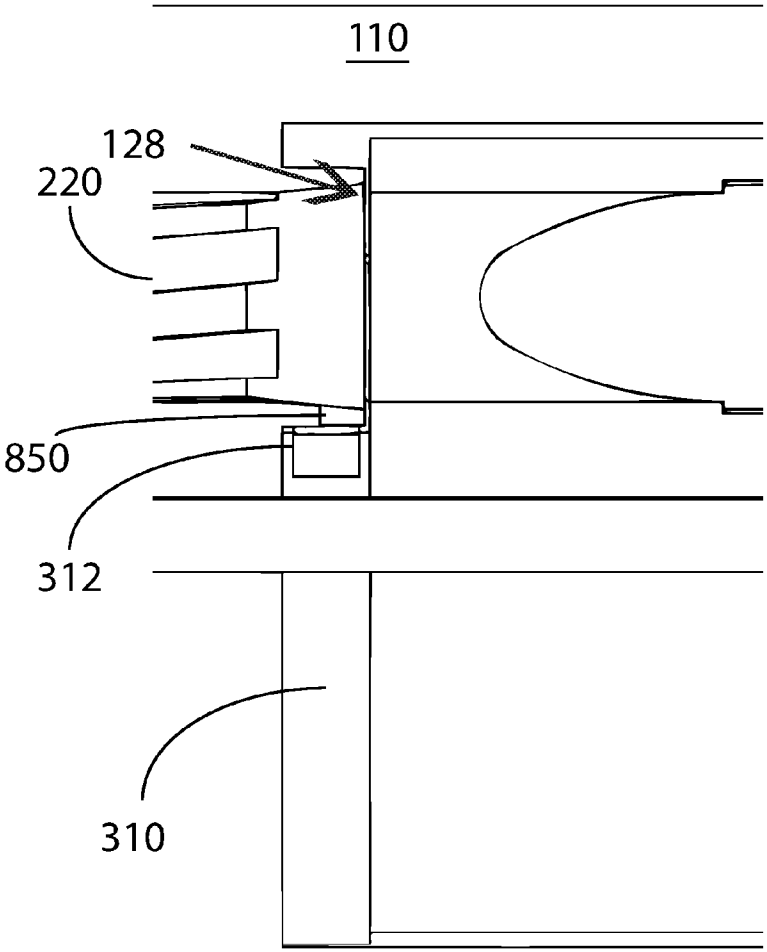
FIG. 16 a sectional view, taken along line A-A of FIG. 2, of the revolver utilizing the louver of FIG. 9, with a ported barrel.

In the event that additional pressure is needed to expand the alternate revolver louver 310, or any other expanding embodiment, a ported alternate barrel 220 can be used to direct gases into the expansion groove 312 to aid in the thin walls expanding against the frame 110 and cylinder 112, as shown in FIG. 16. The port 850, or ports, can be circular, elongated, or any other shape, and in any direction. Additionally, there may be one port present, or multiple ports present, in the alternate barrel 220. The port or ports of the alternate barrel 220 can intersect the barrel-cylinder gap 128, or not.

Figure 17:
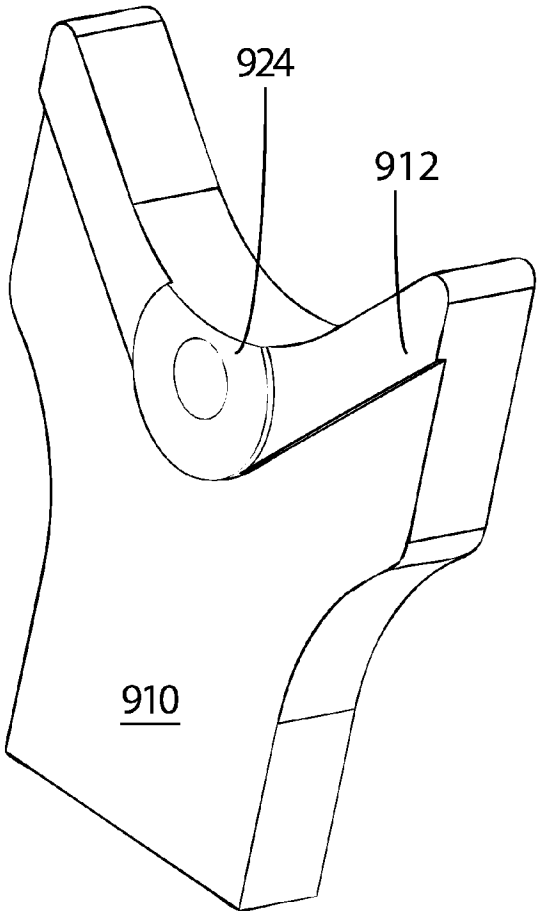
FIG. 17 is a perspective view of an eighth embodiment of a revolver louver, which has a stepped construction.
Figure 18:
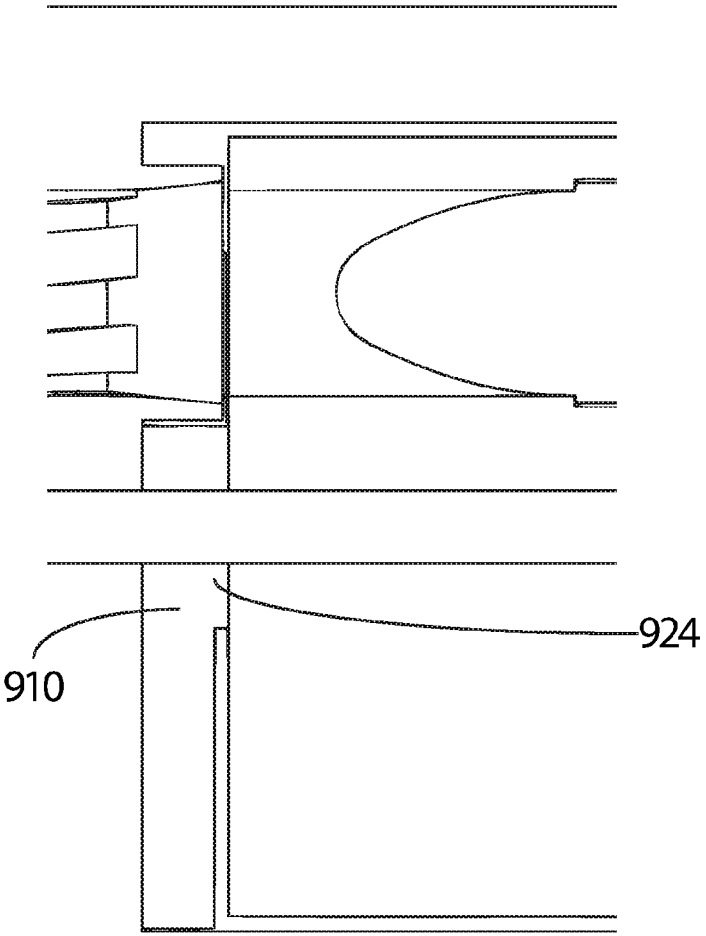
FIG. 18 is a sectional view, taken along line A-A of FIG. 2, of the revolver utilizing the embodiment of the louver as shown in FIG. 17.

Shown in FIGS. 17 and 18 is another alternate revolver louver 910 featuring a stepped construction. This alternate revolver louver features an alternate bushing feature which projects toward the cylinder from a planar surface of the louver. The louver relief step 912 is non-planer with the alternate bushing feature 924, faces towards the cylinder 112 and is located along an edge of the louver along the passage defined for gas redirection. This stepped construction aids in the cylinder 112 rotating smoothly, even if debris accumulates on cylinder 112. Additionally, the louver relief step may or may not be planer with the body of the alternate revolver louver 910.

Figure 19:
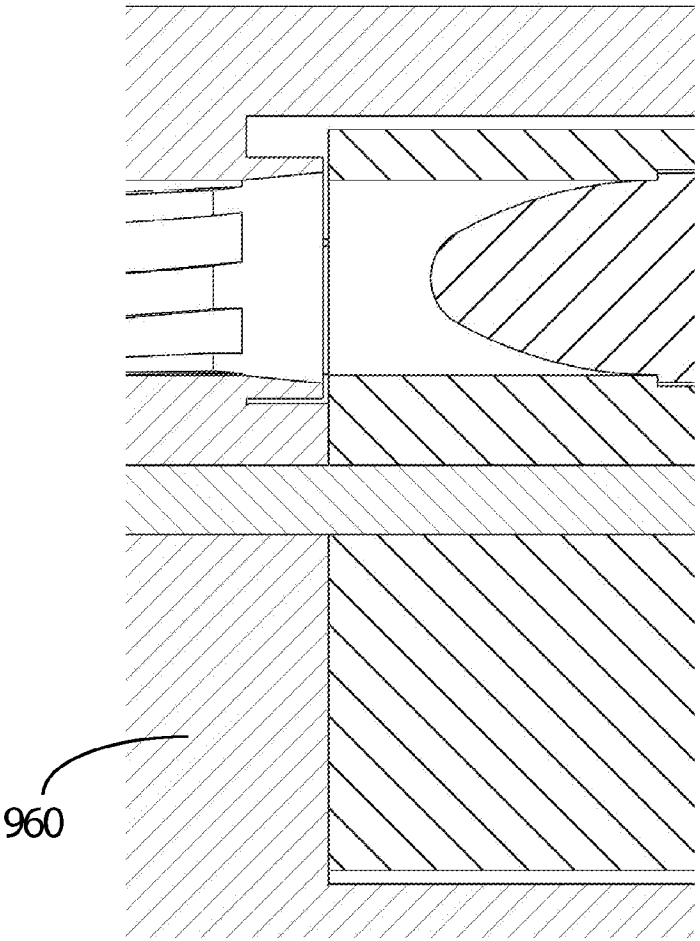
FIG. 19 a sectional view, taken along line A-A of FIG. 2, of a revolver utilizing an integrated louver structure.
Figure 20:
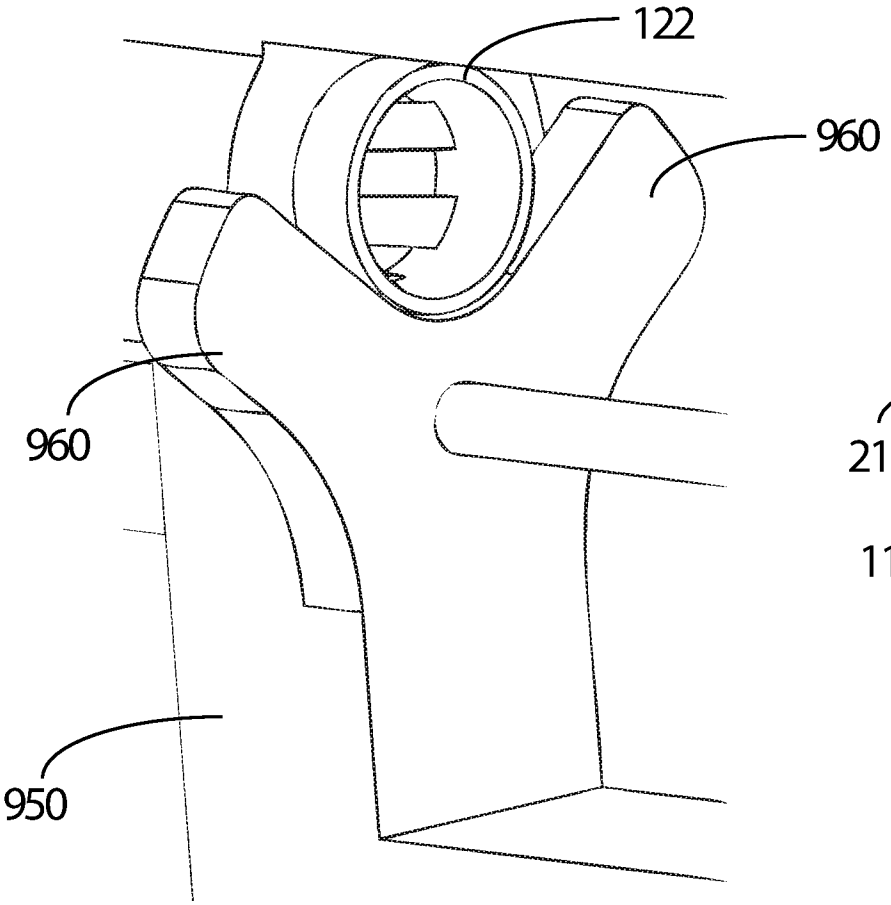
FIG. 20 is a partial rear perspective view of the revolver of FIG. 19, without the cylinder.

FIGS. 19 and 20 depict a further embodiment where the frame 950 is extended to reduce the frame-cylinder gap to the clearance normally required of the support bushing 124 (FIG. 4), which is to say on the order of 0.001 inches. Two arms 960 extend upward to surround the barrel 120 of the firearm and maintain the 0.001 inch clearance, thereby serving as a louver insert as described above. In essence, this embodiment is as if the initially described louver embodiment 210 (FIGS. 7 and 8) were brazed or otherwise attached to the frame 110 directly.

Although the present invention has been described with reference to preferred embodiments, numerous modifications and variations can be made and still the result will come within the scope of the invention. The shape of the louver has been described as being preferably Y- or U-shaped with a passage extending upwards as this is the typically safest direction in which to direct the gases resultant from firing the weapon. However, any shape may be utilized and such gases may be directed in any direction, including utilizing a singular arm which acts as a unilateral dam or a partial ring, so long as it is sufficient to re-direct gases away from the user. No limitation with respect to the specific embodiments disclosed herein is intended or should be inferred.

What is claimed is:

1. A revolver having a frame that has a clearance on the order of 0.001 inches from a front of a cylinder of the revolver and also has at least one arm that which partially surrounds a barrel of the revolver and will redirect gases generated from firing the revolver.

2. The revolver of claim 1, the frame having two arms which co-operate to direct gases upward.

3. The revolver of claim 1, the at least one arm maintaining a clearance on the order of 0.001 inches from the cylinder.

* * * * *